US011193299B2

(12) United States Patent
Andre et al.

(10) Patent No.: US 11,193,299 B2
(45) Date of Patent: Dec. 7, 2021

(54) EMERGENCY SHELTER FOR AT LEAST ONE PERSON, METHOD FOR CONVERTING THIS FROM A FOLDED POSITION TO A DEPLOYED POSITION, AND MODULE OF SUCH SHELTERS

(71) Applicant: HUTCHINSON, Paris (FR)

(72) Inventors: Sébastien Andre, Montargis (FR); Céline Girault, St Pierre des Corps (FR); Raphaël Nadjar, Chanteau (FR); Denis Godeau, Vieilles Maisons sur Joudry (FR); Katarzyna Avril, Montigny le Bretonneux (FR)

(73) Assignee: Hutchinson, Paris (FR)

( * ) Notice: Subject to any disclaimer, the term of this patent is extended or adjusted under 35 U.S.C. 154(b) by 45 days.

(21) Appl. No.: 16/480,740

(22) PCT Filed: Jan. 25, 2017

(86) PCT No.: PCT/FR2017/050171

§ 371 (c)(1),
(2) Date: Jul. 25, 2019

(87) PCT Pub. No.: WO2018/138418

PCT Pub. Date: Aug. 2, 2018

(65) Prior Publication Data

US 2019/0383054 A1 Dec. 19, 2019

(51) Int. Cl.
*E04H 15/20* (2006.01)
*E04H 15/26* (2006.01)
(Continued)

(52) U.S. Cl.
CPC ..... *E04H 15/20* (2013.01); *E04H 15/10* (2013.01); *E04H 15/26* (2013.01); *E04H 15/12* (2013.01);
(Continued)

(58) Field of Classification Search
CPC ... E04H 15/20; E04H 2015/201; E04H 15/26; E04H 15/28
See application file for complete search history.

(56) References Cited

U.S. PATENT DOCUMENTS 4,655,008 A * 4/1987 Parish ..... E04H 15/20 254/93 HP
4,932,169 A * 6/1990 Charbonneau ..... E04H 15/20 52/2.18
(Continued)

FOREIGN PATENT DOCUMENTS

WO WO 2009/005537 A1 1/2009
WO WO 2016/148659 A2 9/2016
WO WO-2016204313 A * 12/2016 ..... E04H 9/00

OTHER PUBLICATIONS

English translation of WO 2016/04313 A1 from espacenet.com.*
International Search Report and Written Opinion for Application No. PCT/FR2017/050171 dated Oct. 18, 2017, 12 pages.

*Primary Examiner* — David R Dunn
*Assistant Examiner* — Danielle Jackson
(74) *Attorney, Agent, or Firm* — Alston & Bird LLP

(57) ABSTRACT

Provided is an emergency shelter that is able to occupy a first, folded position for storage and transport and a second deployed position that is suitable for sheltering at least one person, a method for reversibly converting the shelter from this first position to this second position, and a module of contiguous shelters of this kind. The emergency shelter includes an inflatable tent and a retention device in the form of a column that is preassembled with the inflated tent in said second position. The column is suitable for inflating the tent and holding it deployed around the former in said second position.

29 Claims, 9 Drawing Sheets

(51) Int. Cl.
*E04H 15/10* (2006.01)
*E04H 15/12* (2006.01)
*E04H 15/36* (2006.01)

(52) U.S. Cl.
CPC ..... *E04H 15/36* (2013.01); *E04H 2015/201* (2013.01)

(56) References Cited

U.S. PATENT DOCUMENTS

| | | | | |
|---|---|---|---|---|
| 5,002,082 | A * | 3/1991 | Roder | E04H 15/28 135/88.01 |
| 5,222,513 | A * | 6/1993 | Hilliard | E04H 15/18 135/117 |
| 5,226,261 | A * | 7/1993 | Wilbourn | B60J 7/102 52/2.21 |
| 5,394,897 | A * | 3/1995 | Ritchey | E04H 15/18 135/117 |
| 6,192,633 | B1 * | 2/2001 | Hilbert | E04H 1/1277 52/2.18 |
| 6,875,119 | B2 * | 4/2005 | Murphy | E04H 15/22 472/134 |
| 8,001,985 | B1 | 8/2011 | Conner | |
| 2002/0083653 | A1 | 7/2002 | Hilbert | |
| 2006/0180189 | A1 * | 8/2006 | Bambei | E04H 15/26 135/98 |
| 2015/0336644 | A1 * | 11/2015 | Cho | A62B 31/00 441/87 |
| 2020/0340268 | A1 * | 10/2020 | McGlynn | E04H 15/26 |

* cited by examiner

Fig. 15
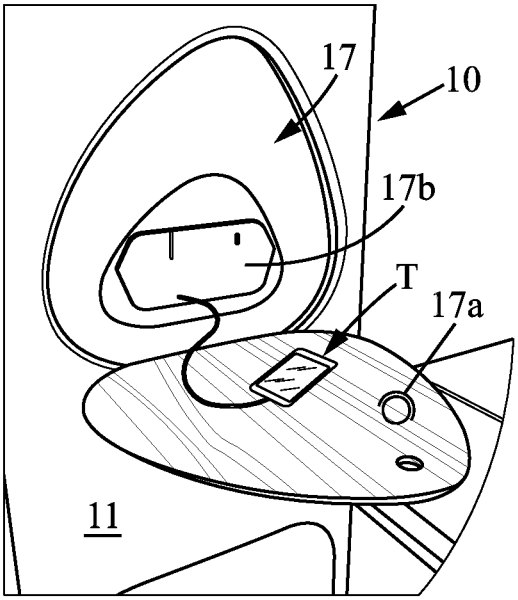
Fig. 14
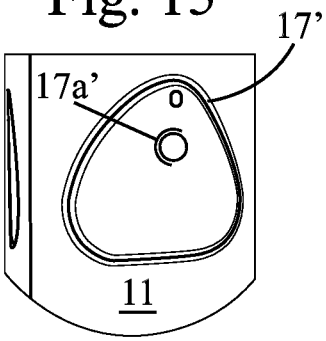
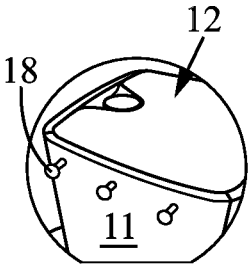
Fig. 16
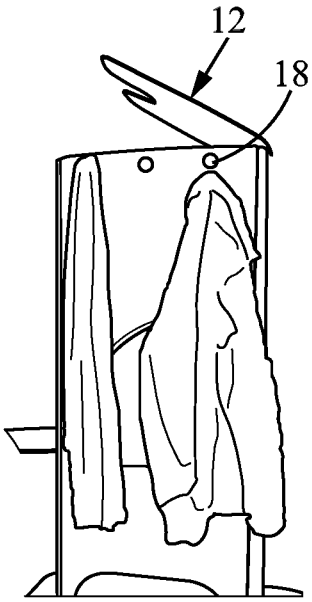
Fig. 17
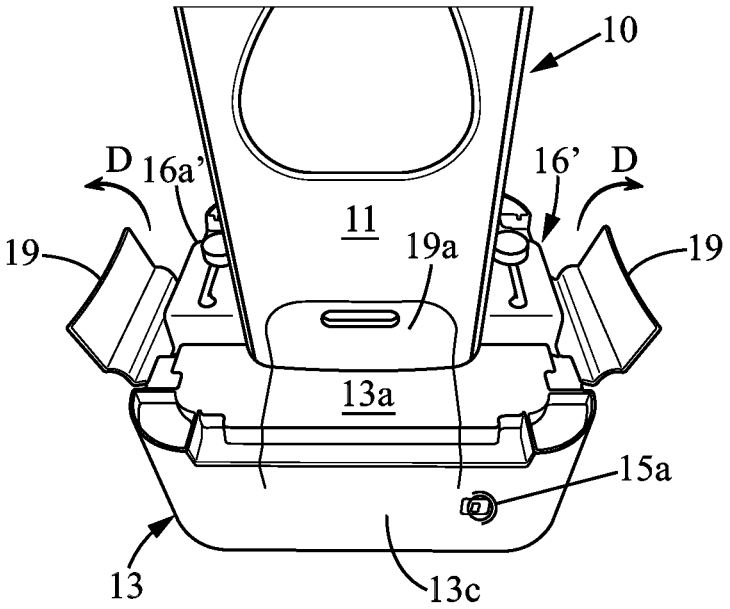
Fig. 18

Fig. 21
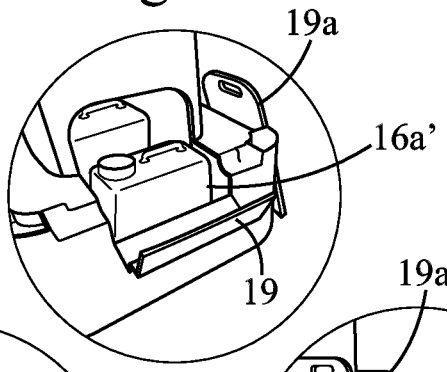
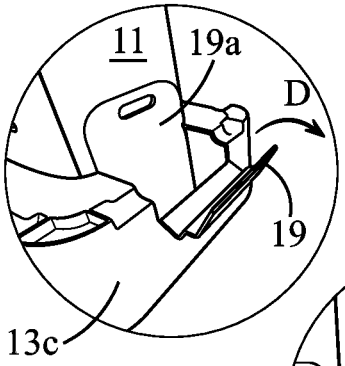
Fig. 19
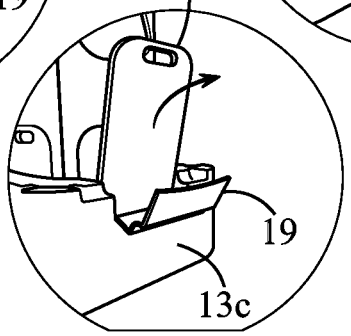
Fig. 20
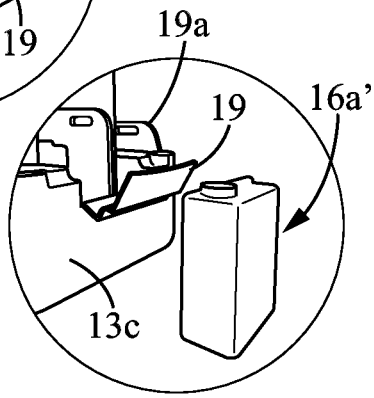
Fig. 22
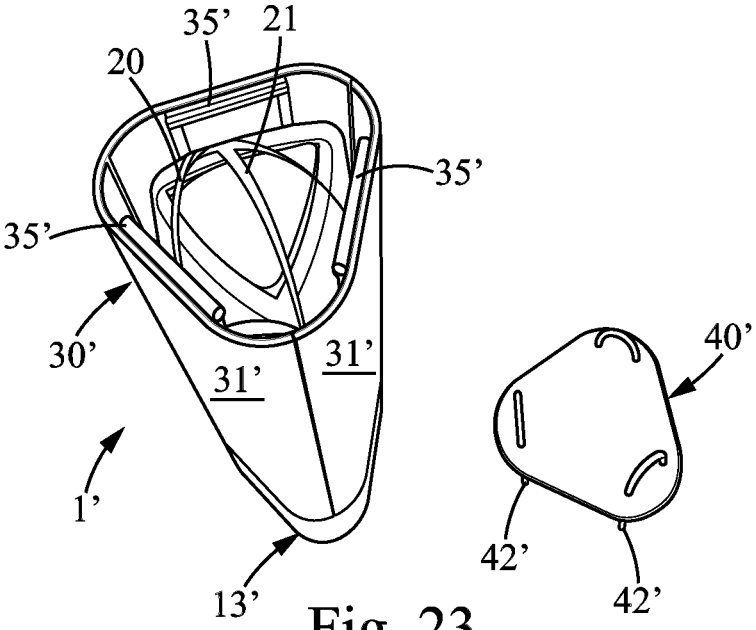
Fig. 23

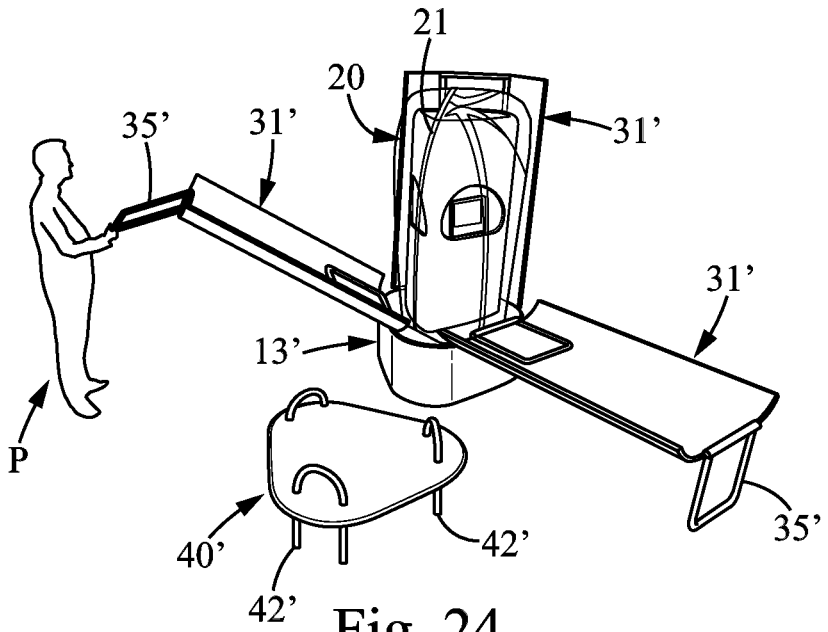
Fig. 24
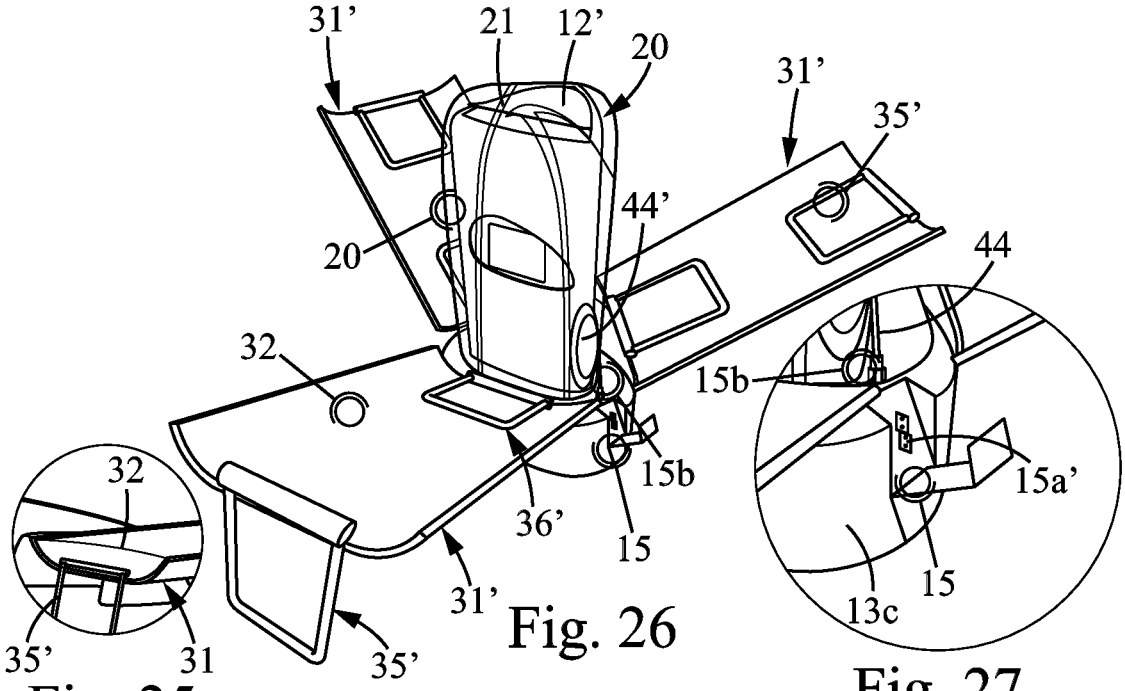
Fig. 25
Fig. 26
Fig. 27

EMERGENCY SHELTER FOR AT LEAST ONE PERSON, METHOD FOR CONVERTING THIS FROM A FOLDED POSITION TO A DEPLOYED POSITION, AND MODULE OF SUCH SHELTERS

CROSS-REFERENCE TO RELATED APPLICATIONS

This application is a national phase entry of International Application No. PCT/FR2017/050171, filed Jan. 25, 2017, the entire contents of which are incorporated herein by reference.

FIELD

The present invention concerns an emergency shelter adapted to occupy a first, folded position for storage and transport and a second, deployed position, able to shelter at least one person, a method for reversibly converting the shelter from that first position to that second position, and a module of contiguous shelters of that kind. The invention applies in particular to a shelter that can be modulated and is adapted to receive comfortably for a short time period (typically from a few hours to a few days) a number of persons physically injured and/or psychologically victims of natural disasters, accidents, wars or any other traumatizing event (including refugees) needing to be taken care of at least psychologically. The invention may nevertheless also be applied to the programmed reception of any civilian or military populations including festival goers or sports spectators during outdoor events for example.

BACKGROUND

Health and rescue professions (including fire and rescue services), charitable associations, civil protection associations and volunteers undertaking emergency rescue medical-psychological actions in response to natural disasters, accidents or wars often need to have rapidly available enclosed spaces able to provide at least psychological comfort to physically and/or psychologically injured persons escaping from such traumatizing events, for example in the context of operations supporting advanced rescue or medical stations. These enclosed spaces, which are usually delimited by tents with rigid frames or inflatable ribs, have to be mobilizable, partitionable and deployable quickly whilst providing internal spaces sufficiently equipped and comfortable to reassure the victims that they receive, to attenuate their trauma and to make available to them a few commodities able to provide them with wellbeing even of short duration.

The document U.S. Pat. No. 8,001,985 B1 discloses an emergency shelter constituted, in a folded storage and transport position, of a parallelepipedal enclosure the six faces of which are formed by six articulated rectangular panels intended to constitute a raised floor of the shelter following deployment thereof to a horizontal position and assembly thereof to three other identical panels stacked inside the enclosure, which contains, in the form of separate parts:

- a folded flexible tent that can be inflated into a dome shape by two air chambers respectively provided between internal and external layers of the tent and by inflatable ribs, and
- a kit of elements that are intended to form a multifunctional column connected at the top to the tent by spaced pillars that include containers of survival accessories (e.g. water, batteries, lights, communication means) and inflatable furniture independent of the column.

To obtain the position of use of this shelter, the column is assembled in the form of an open structure delimited by these pillars interconnected by a low table and a high shelf around a stove at the bottom connected to a duct for evacuating smoke.

A major disadvantage of the shelter described in the above document is the relatively long time it takes to prepare it and deploy it, i.e. to access the tent and the various items and furniture stored inside the enclosure, to unfold and inflate the tent and the furniture extracted from the enclosure, to assemble the column by first positioning it on the floor panels provided in the enclosure, and then to connect the column to the tent.

SUMMARY

An object of the present invention is to propose an emergency shelter that in particular remedies this disadvantage and is able to occupy a first, folded position for storage and transport and a second, deployed position for sheltering at least one person, the shelter including an inflatable tent and a device for retaining the inflated tent in said second position.

To this end, the shelter according to the invention is such that the retaining device includes a pre-assembled column to which the uninflated tent is fixed in said first position, the column being adapted to inflate the tent and to retain it deployed around it in said second position.

It will be noted that the column according to the invention, which is therefore pre-assembled in the first, folded position of the shelter (a compact position allowing its storage and transport with a small overall size) enables, unlike the kit column from the document U.S. Pat. No. 8,001,985 B1, a valuable timesaving for converting the shelter according to the invention into its second, deployed position given that this column according to the invention already has inside the folded shelter its definitive geometry for use of the deployed shelter.

It will also be noted that the inflatable tent is already fixed to the column according to the invention in the first, folded position of the shelter, which also enables time to be saved in converting it to the second, deployed position.

It will further be noted that the column is adapted (i.e. is capable on its own by means of an appropriate inflation unit) to inflate the tent and to ballast it in use, maintaining it deployed around it in the second position (the column being position eccentrically or otherwise relative to the center of the tent), this autonomous inflation by the column itself and this initial and permanent fixing of the tent to the column enabling further significant reduction of the total time needed to deploy the shelter.

To summarize, the permanent (because pre-assembled) structure of the column and its connection to the tent advantageously enable deployment of the tent alone (by means of the column alone) to convert the shelter from the first position to the second position, given that the column is deployed beforehand (i.e. has a structure and a height substantially invariant along its vertical axis of symmetry between the first and second positions) and connected beforehand to the tent, unlike the shelter from the document U.S. Pat. No. 8,001,985 B1.

The cumulative height of the column and the connecting means of the shelter according to the invention in said second, deployed position, is advantageously made sufficient to provide a sufficient height of the tent enabling persons admitted thereto to stand and to walk around inside the tent without needing to duck.

A shelter according to the invention may advantageously have a capacity to receive at least ten persons and a footprint of at least 20 $m^2$.

According to another feature of the invention, the column may include in said first position and said second position a peripheral column wall of globally polygonal or curved cross section onto and around which wall the tent is folded in said first position.

Here by "wall of globally polygonal or curved cross section" is meant a wall defining a surface generated by the movement of a generatrix at the perimeter of a directrix formed by a closed line, such as for example a prismatic or pyramidal wall (including a frustum of a pyramid) in the case of a polygonal cross section or a cylindrical or conical wall (including a frustum of a cone) in the case of a curved cross section.

Said peripheral column wall is preferably globally cylindrical or prismatic.

Here by "cylindrical wall" is generally meant a wall defined by a directrix in the form of a closed curved, e.g. circular or elliptical, line extending along a generatrix, preferably forming a right cylinder of circular section.

Here by "prismatic wall" is generally meant a wall defined by a polygonal, for example square or triangular, directrix and by a generatrix that is perpendicular to it in the preferred case of a right prism.

In the present description by "globally cylindrical" and "globally prismatic" is meant a wall geometry encompassing:

- small variations of the cross section of the column wall along its vertical axis of symmetry, and/or
- a shape of that cross section that features minimal departures (e.g. flats, recesses and/or reliefs) relative to a curved, for example circular or elliptical, directrix in the case of a globally cylindrical wall, and equally minimal departures (e.g. rounded rather than angular corners) relative to a closed polygonal line in the case of a globally prismatic wall.

It will be noted that the peripheral column wall of globally polygonal or curved cross section is common to the first and second positions that characterize said wall without that wall suffering structural modification, and that this column wall therefore has an essentially closed geometry, unlike the mostly open geometry of the column from the document U.S. Pat. No. 8,001,985 B1.

It will also be noted that in said first position the as yet uninflated tent is beforehand folded onto and around this peripheral wall (i.e. the folding tent surmounts and surrounds that wall), unlike the tent from the document U.S. Pat. No. 8,001,985 B1 that is folded only on itself in its storage enclosure without being positioned in any manner whatsoever relative to the column kit.

According to another feature of the invention, the retaining device may further include means for connecting the tent to the column such as cables (e.g. textile or metal slings or stays) or a tubular membrane (e.g. a textile tube), that surmount the column and are deployable to pass from said first position to said second position in which the column provided with said connecting means ballasts the tent.

It will be noted that these connecting means secured to a top of the column may be tensioned by inflating the tent.

According to another feature of the invention, the column advantageously contains a unit for inflating the tent by means of inflatable ribs, said inflation unit including a compressor or a pyrotechnic generator of gas under pressure, and/or at least one reservoir intended to contain a compressed gas and adapted to be connected to at least one of said ribs to be inflated.

It will be noted that this pyrotechnic gas generator enables rapid inflation of the inflatable ribs equipping the tent in the manner of airbags. In order to alleviate the relative nuisance of the noise generated by the sudden expansion of the gas to inflate the ribs, there may alternatively be provided in the column a plurality of reservoirs of gas under pressure (e.g. bulbs containing carbon dioxide, for example) respectively adapted to be connected to the ribs to be inflated by as many inflation tubes (i.e. a reservoir for inflating each rib).

According to one example of the invention, the tent includes a flexible fabric or canvas that interconnects the ribs and incorporates photovoltaic modules (provided on the external face side of the canvas) and/or resistive heating elements (provided on the internal face side of the canvas).

The column advantageously has a base that supports said peripheral column wall and may be provided with means such as wheels facilitating guiding movement of the shelter in said first position, said base optionally containing an electrical power supply unit of the column connected to said inflation unit.

This electrical power supply unit may advantageously include a rechargeable battery.

Said base may advantageously further contain said inflation unit that opens from said base via an inflation orifice adapted to be connected in an airtight manner to at least one tube for inflating the tent with which the column may be provided, said base having a façade provided with a means for commanding and stopping inflation.

Tests carried out by the Applicant have enabled inflation in approximately 3 minutes of the tent, advantageously a flexible canvas tent with inflatable ribs conferring on it a dome shape with a footprint equal to 25 $m^2$.

Even more advantageously, the column may further incorporate a unit for monitoring the tent inflation parameters, such as, to give a nonlimiting example, the inflation pressure.

According to another feature of the invention, said peripheral column wall may further contain a unit for supplying drinking water and washing water for said at least one sheltered person.

Said unit for supplying drinking water and washing water advantageously includes at least one drinking water reservoir and a receptacle of cups, both accessible from the top of the column, and a washbasin in said peripheral column wall communicating with said reservoir via a tap and with said cup receptacle.

Even more advantageously, said base may further contain a unit for recovering waste water, said base and/or an adjacent lower part of said peripheral column wall including removable or pivoting external panels enabling access to said recovery unit.

According to another feature of the invention, the column may further include a storage battery and at least one secure rack for storing personal effects of said at least one person, at least one coat hook and at least one small folding table for example suitable for consulting and/or charging by means of said battery devices such as laptop computers or smartphones Advantageously, the column may advantageously further include self-contained lighting means (e.g. of light-emitting diode (LED) type) able to light in an adjustable manner by means of at least one lighting cone, from an upper end of the column, the interior of the tent deployed in said second position and optionally also one or more particular locations on the column (e.g. the small table receiving a laptop computer and/or the washbasin).

It will be noted that a shelter column according to the invention advantageously has a multifunctional structure able to contribute to the comfort and wellbeing of the sheltered persons, including by way of nonlimiting example, in addition to the tent inflation function, by providing:

- washing products (e.g. for the face and the hands),
- drinking water and possibly food,
- autonomous lighting and possibly heating,
- storage of personal effects,
- a network connection (for example a WiFi connection via a minicomputer inside the column) so that the sheltered persons are able to access the Internet and use a laptop computer placed for example on a small table pivoting on the column, and
- electrical socket outlets for example at 5 V (USB), 12 V and 220 V for charging devices such as computers and mobile telephones.

It will be noted that, in the first, folded position, the shelter may advantageously be connected via its column to an electrical mains supply or to the battery of a nearby vehicle to charge its battery and a water evacuation pipe for draining said wastewater recovery unit.

According to another aspect of the invention, the shelter further includes a lockable casing which, in said first position, envelops the tent folded around a peripheral wall of said column of globally polygonal or curved cross section, said casing being adapted to be separated (i.e. disengaged) from the tent and from said peripheral column wall to allow inflation of the tent.

Said casing advantageously includes at least two casing modules that can be folded after unlocking by pivoting about a vertical axis of symmetry of the column, said casing modules together having before being folded a preferably globally cylindrical or prismatic geometry around said axis like said peripheral column wall.

It will be note that disengaging the casing from the tent in this way, by separating it from the peripheral column wall, could alternatively be effected by sliding (i.e. movement in translation) of the casing around and along the virtual axis of symmetry of the column.

Even more advantageously, said casing modules may be mounted to pivot independently of one another on a base of the column before inflating the tent, each of said casing modules being optionally separatable from the column and adapted to be disposed on ground receiving the shelter to form there furniture and/or a ground covering element such as a floor panel, for example of duckboard type (these duckboard panels possibly forming all or part of the casing have the advantage that the openings therein reduce the development of mold on the tent that may be wet and soiled after each use).

According to one particular embodiment of the invention, at least one of said casing modules is advantageously provided with retractable and optionally telescopic legs and is adapted to form said furniture that is optionally inflatable by said column and is selected from tables and seats such as stools or benches.

By way of optionally inflatable furniture formed by said at least one casing module there may be cited for example a bench with an optionally inflatable cushion (for example a foam cushion if not inflatable) and/or a table, the bench being for example designed to receive at least two persons seated at the table or at least one person lying down. Said at least one casing module may advantageously be adapted to form on its own a bench or a table by reversible deployment of its legs, positioning the cushion of the module at the top or at the bottom, respectively.

At least one of said casing modules may advantageously have an external face provided with means for holding and/or guiding the shelter in said first position such as handles, ramps or rails, with a view to moving it and transporting it in a vehicle.

It will be noted that the shelter according to the invention has a small volume (with a height essentially determined by that of the column) facilitating moving it and loading/unloading it into/from a motor vehicle for example of SUV (Sport Utility Vehicle), van or trailer type via these holding and guiding means.

Equally advantageously, the shelter may further include a cap removably surmounting said peripheral column wall and in said first position locking said casing modules around the tent, said cap optionally enclosing a tube for inflating the tent adapted to be connected to an inflation unit contained in the column.

This cap may advantageously serve as a low table inside the deployed shelter, once demounted from the column and positioned on the floor of the shelter.

Tests carried out by the Applicant have enabled at most two persons to deploy the whole of the shelter in approximately 15 minutes, this deployment of the shelter including in particular unlocking and deploying the casing modules and inflating the tent plus deploying its means of connection to the column.

The shelter according to the invention may advantageously be further provided with a WC in the form of a module separate from the casing-tent-column assembly, for example a folding WC equipped with a single-use plastic bag installed in a separate individual tent. This tent containing a WC is preferably installed outside and near the shelter according to the invention so as not to interfere with other persons in that shelter.

As explained in the preamble, a shelter according to the invention is particularly useful for a short time period not exceeding a few days (typically three days maximum), or even a few hours, remembering that it is in particular designed:

- to be deployed rapidly, folded and easily transportable,
- to reassure victims by isolating them for a short time from the traumatizing event and protecting them from media exposure inside a tent that is lit, possibly heated or cooled to a comfortable temperature as a function of the external conditions and possibly provided with means for cleaning and disinfecting the shelter,
- to enable victims to slake their thirst, to wash their hands and face and to use toilets via the aforementioned WC tent,
- to enable victims to contact their loved ones and information or medical services onsite via the telecommunication means incorporated in the column,
- to have a modular nature that can be adapted according to the situation, given that the column is able to contain inside the tent once inflated supplementary units over and above those described above, such as means for compartmenting the internal space of the canvas/vertical curtain type partly supported by one or more rib(s) and/or stay(s) connected to the column, or of for example zipped partition type (e.g. to preserve the privacy of persons receiving care), and
- to enable the victims to rest and possibly to receive first aid on the furniture in the shelter (advantageously provided with optionally inflatable cushions) in conjunction with rescue and/or medical stations for example for longer term care, whence a reduction in the long term of additional medical costs.

It will be noted that a number of shelters according to the invention may advantageously be interconnected by forming a local area network, for example a WiFi network, so that victims in shelters that are far apart are nevertheless able to communicate with each other.

A method according to the invention for reversibly converting an emergency shelter from a first, folded storage and transport position to a second, deployed position adapted to shelter at least one person, the shelter including an inflatable tent retained in said second position, includes:

a) providing a column that is preassembled before said first position is obtained, b) fixing the uninflated tent to the column to obtain said first position, and c) inflating the tent by means of the column to obtain said second position in which the inflated tent is deployed around the column and retained by the column.

According to another feature of the invention, the step b) may include folding the tent onto and around the column inside a lockable casing around the tent parallel to a vertical axis of symmetry of the column.

According to another feature of the invention, said casing is separated from the tent and from the column between the steps b) and c) to allow the step c).

Said casing may be advantageously separated from the column by folding around said axis at least two modules of said casing mounted to pivot on the column in an optionally separatable manner, and said at least two folded casing modules may be used as furniture such as tables or seats and/or as elements for covering a floor of the shelter such as floor panels.

A module of contiguous emergency shelters according to the invention includes a plurality of shelters as defined hereinabove that are interconnected by flexible partitions or awnings with openings adapted to be closed, for example by zippers.

BRIEF DESCRIPTION OF THE DRAWINGS

Other features, advantages and details of the present invention will emerge on reading the following description of examples of the invention given by way of nonlimiting illustration and with reference to the appended drawings, in which:

FIG. 14 is a partial perspective view of another face of the wall of the column from FIG. 10 showing a compartment for charging a mobile telephone, FIG. 15 is a partial view of a secure storage compartment of the column from FIG. 10 in the closed position, FIGS. 16 and 17 are partial perspective and front views showing an upper zone of the column from FIG. 10 equipped with coat hooks, FIG. 18 is a partial perspective view showing a lower zone and the underlying base of the column from FIG. 10 in an open position for access to the wastewater, FIGS. 19, 20, 21 and 22 are partial perspective views showing details of four phases of recovering wastewater by means of the lower zone and the base of the column shown in FIG. 18, FIG. 23 is a perspective view from above of a shelter according to a second embodiment of the invention in its first, folded position, the cap of the casing having been removed and the tent folded onto the column being visible, FIG. 24 is a perspective side view of the shelter from FIG. 23 in an intermediate phase of disengagement of the casing by an operative with a view to deploying the shelter, FIG. 25 is a partial perspective side view showing in detail a cushion of a bench that is formed by a module disengaged from the casing and optionally inflated by the column, FIG. 26 is a perspective side view of the shelter from FIG. 24 in a subsequent phase of disengagement of the casing with a view to deploying the shelter, FIG. 27 is a partial perspective side view showing in detail the means on the column for commanding inflation of the tent and optionally the cushions of the modules of the casing.

DETAILED DESCRIPTION

Figure 28:
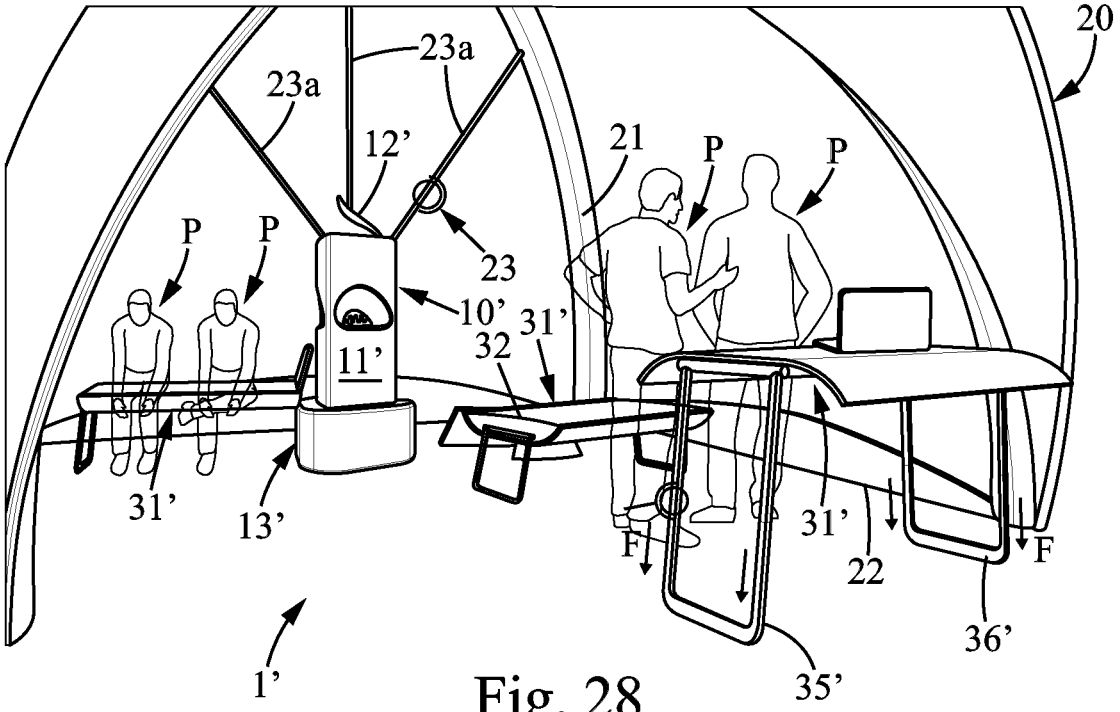
FIG. 28 is a partial perspective side view of the interior of the shelter from FIG. 23 receiving persons in its second, deployed position following inflation of the tent, and optionally of the cushions of the casing modules, and arrangement of those modules inside the shelter.
Figure 29:
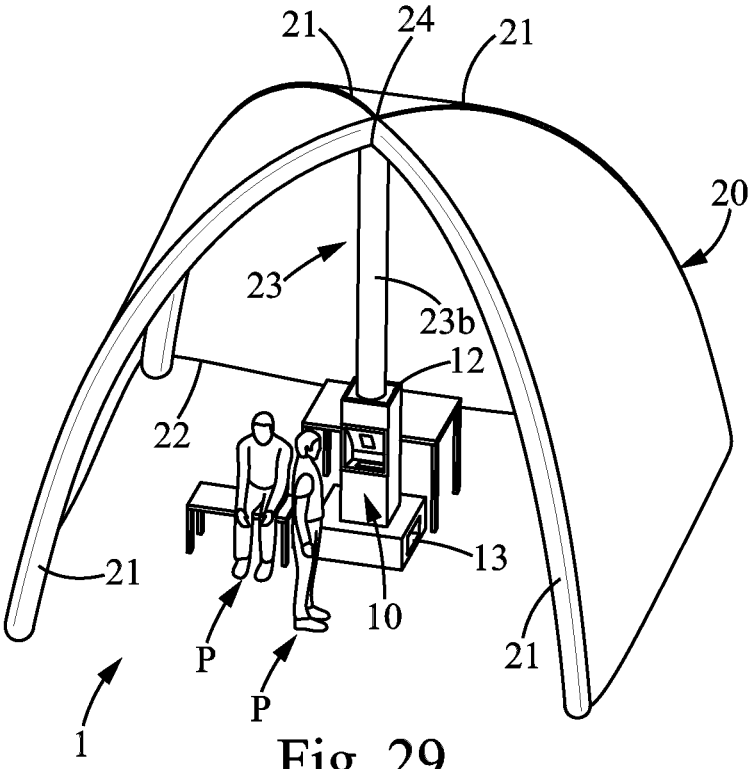
FIG. 29 is a perspective view from above of the interior of a variant of the shelter in accordance with the invention shown in FIG. 28 receiving persons in its deployed position following inflation of the tent and arrangement of the modules of the casing inside the shelter.

The shelter 1 according to the first embodiment of the invention seen in FIGS. 1 to 22 essentially comprises:

- a multifunction column 10 made for example of composite or plastic material having a peripheral column wall 11 of globally prismatic shape defined by a square cross section with rounded corners (see FIGS. 8 and 10 for the right prism geometry with a globally square directrix of the column), therefore with four identical globally rectangular faces of the column 10 facing two by two;
- a flexible canvas tent 20 with inflatable ribs 21 preferably containing trapped air (i.e. sufficiently airtight to retain the inflation air for a long time) adapted to confer a dome shape on the tent 20 in the deployed position of the shelter 1 when inflated by the column 10, with a ground perimeter 22 that is for example substantially polygonal (e.g. square, as shown in FIG. 29), the tent 20 being fixed to the top 12 of the column 10 by connecting means 23 (visible in FIGS. 28-29 in the deployed position of the tent 20) and folded around its peripheral wall 11 (see FIGS. 23-24, 26); and
- a removable casing 30 made for example of composite or plastic material that envelops the column 10 and grips the tent 20 when folded and includes four globally plane rectangular modules 31 each of which is mounted to pivot in a lower zone of one face of the column 10 about a vertical axis X of symmetry of the latter (see FIG. 8), with a view to separating the casing 30 from the column wall 11; and
- a cap 40 for locking/unlocking the casing 30, here having a square geometry, that surmounts the column 10 and the casing 30, capping an upper zone 30*a* of the modules 31 so as to oppose pivoting thereof.

By way of composite materials that may be used for the column 10 and the casing 30, there may for example be cited glassfiber/polyester or epoxy resin composite materials, the column 10 and/or the casing 30 possible including a metal chassis or framework.

Figure 2:
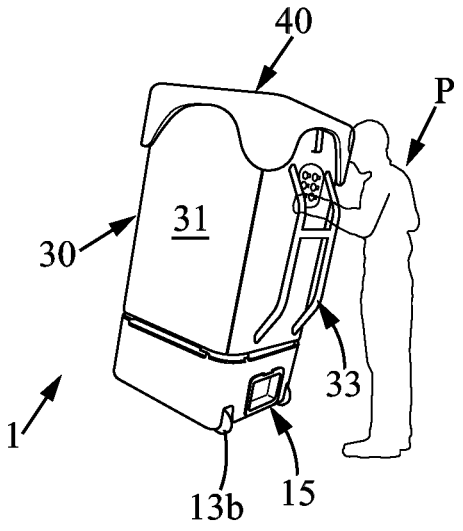
FIG. 2 is a perspective side view from the front of the shelter from FIG. 1 tilted by an operative.
Figure 3:
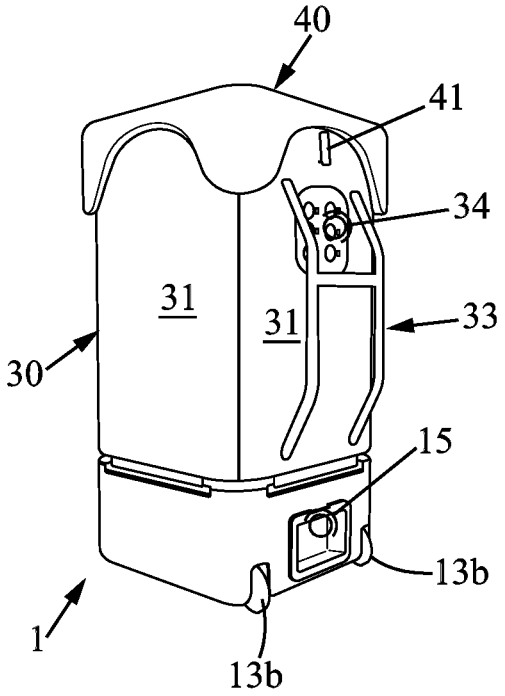
FIG. 3 is a perspective side view to a larger scale of the shelter from FIG. 2 showing means for holding and guiding it.
Figure 4:
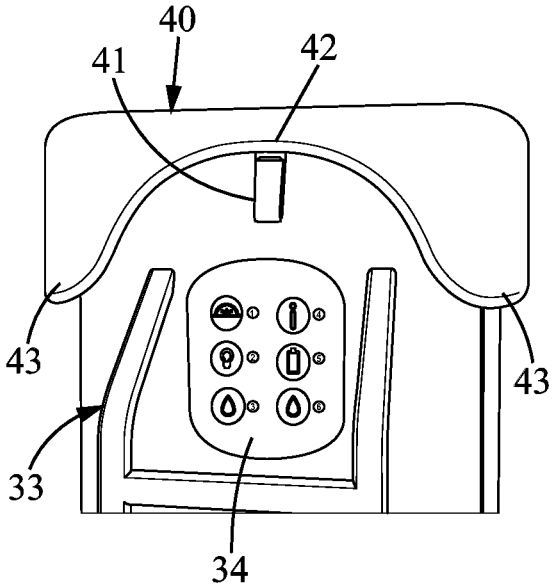
FIG. 4 is a partial view showing in detail the front of the shelter from FIG. 3, showing the casing of its column provided with a cap in the locked position.
Figure 30:
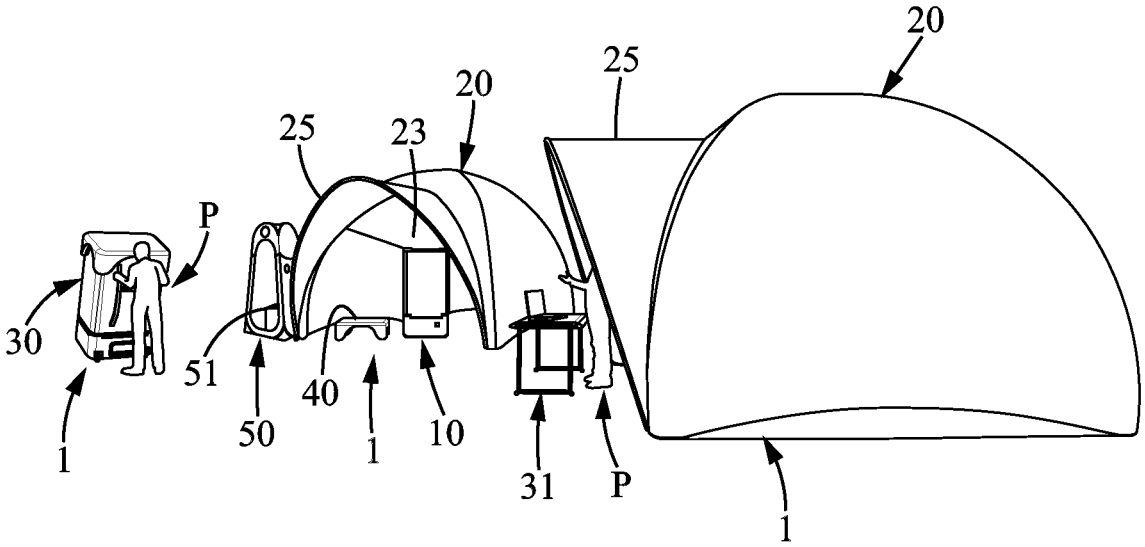
FIG. 30 is a perspective side view of two adjacent deployed shelters according to the invention each provided with a WC tent and a third shelter according to the invention shown in the folded position.

As can be seen in FIGS. 2-3, the column 10 includes an enlarged base 13 of globally square section that supports the wall 11, to the projecting upper face 13*a* of which are articulated the four casing modules 31 and the lower face of which is provided with wheels 13*b* so that an operative can easily roll the shelter 1 in the folded position when inclined following slight tilting (see FIGS. 2 and 30). Alternatively, the column 10 could be movable over the ground without tilting by equipping its base 13 with four wheels 13*b*.

Figure 1:
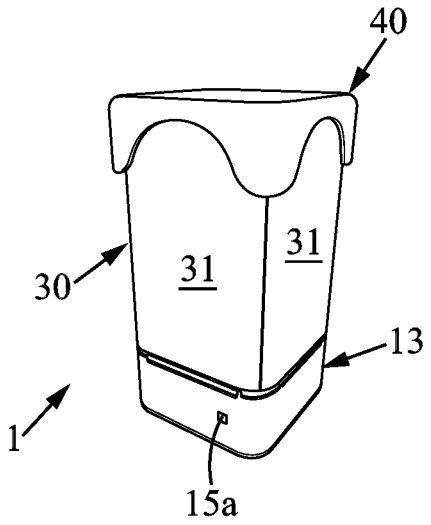
FIG. 1 is a perspective side view from the rear of a shelter according to the first embodiment of the invention in its first, folded position.

The base 13 of the column 10 contains in particular:

- an electrical power supply unit (not visible) of the column 10 including a rechargeable battery,
- a unit 15 for inflating the tent 20 (FIG. 1 shows an inflation button 15*a* located on the lateral façade 13*c* of the base 13, this button 15*a* also being visible in FIG. 18) and optionally for inflating cushions 32 equipping the casing modules 31, and
- a wastewater recovery unit 16'.

Figure 5:
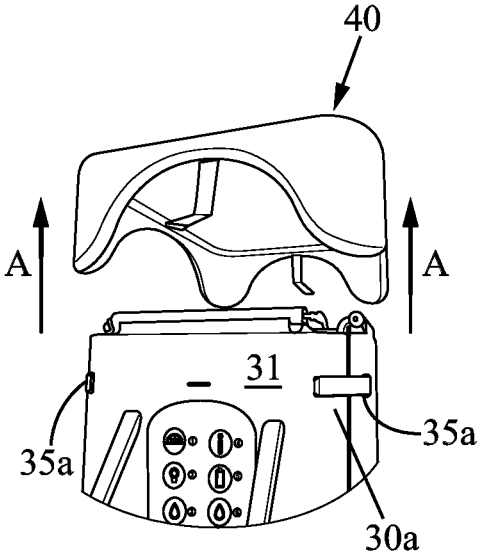
FIG. 5 is a view of the shelter similar to FIG. 4 but showing its casing provided with the cap in the unlocked position in an initial phase of deployment of the shelter.

As can be seen in FIGS. 2-5, one of the casing modules 31 is provided on its external face with guide and holding handles 33 with a view to facilitating movement over the ground and loading/unloading the shelter 1 in the folded position, as well as a label 34 providing an operative P with information for the various phases of deployment of the shelter 1. Each casing module 31 advantageously incorporates means for stiffening it, possibly including for this purpose a double wall with interleaved crossmembers. It is seen in FIG. 5 that consecutive casing modules 31 may be removably secured to one another two by two by means of strips 35*a*, for example of VELCRO® brand fastener type.

Figure 9:
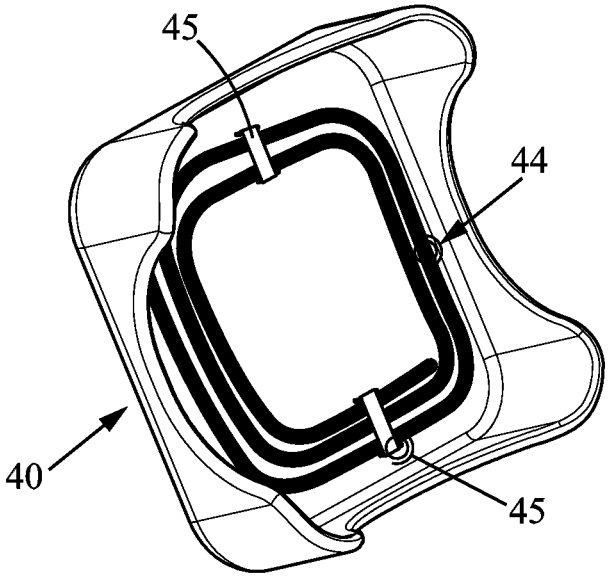
FIG. 9 is a view from below of the cap of the unlocked casing showing the interior of that cap according to one embodiment of the invention.
Figure 10:
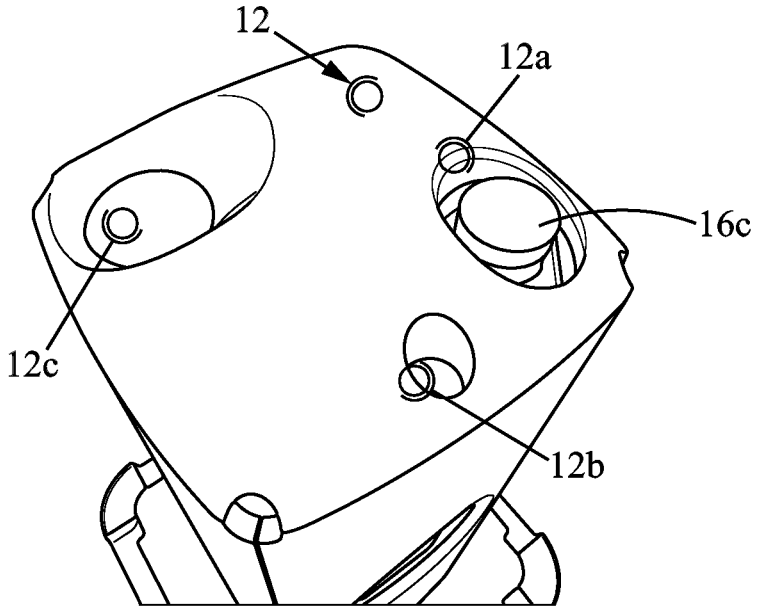
FIG. 10 is a partial perspective view from above of the column of the shelter from FIG. 8 after removing the casing from the column (the tent not being shown)
Figure 11:
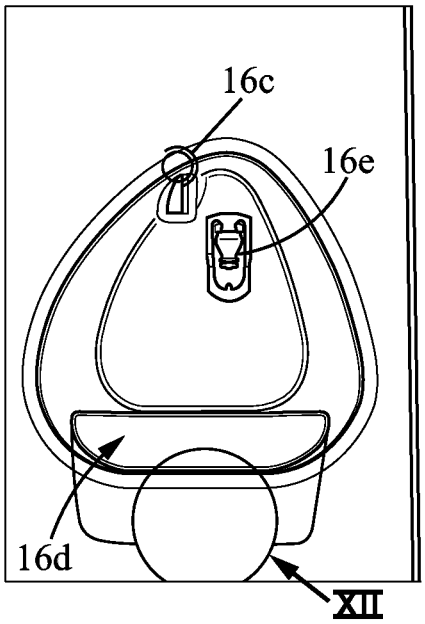
FIG. 11 is a partial front view of one face of the peripheral wall of the column from FIG. 10 showing the washbasin of the shelter.
Figure 12:
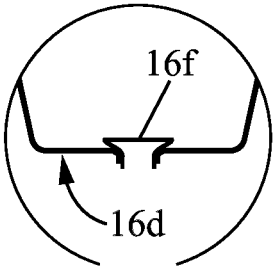
FIG. 12 is a diagram showing the profile of the washbasin from FIG. 11.
Figure 13:
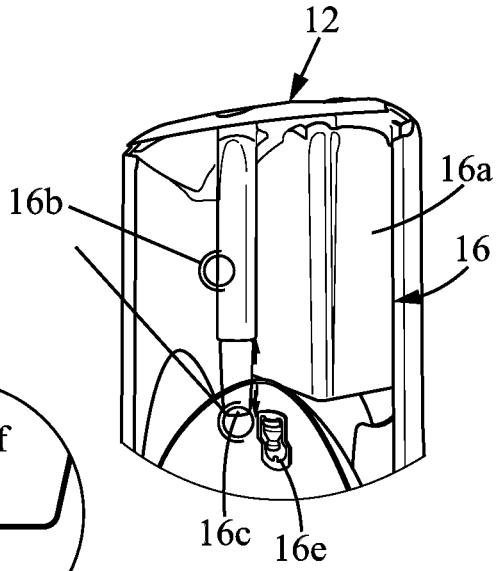
FIG. 13 is a front view of the interior of the column shown in FIG. 11 showing the washbasin and the drinking water supply unit partly visible in FIG. 10.

The cap 40 is removably fixed (see arrow A in FIG. 5 for its removal) to at least one of the casing modules 31 via another strip 41 for example of VELCRO® brand fastener type and consists of a square panel extended at right angles by identical notched extensions 42 on its four sides, each extension capping a corresponding upper zone 30*a* of a casing module 31 with two lower zones 43 for each extension 42 capping both of two consecutive casing modules 31, thereby forming undulations on the contour of the upper zone 30*a* of the casing 30. It is seen in FIG. 9 that the cap 40 is advantageously equipped on its internal face with an inflation tube 44 for inflating the tent 20 and optionally the cushions 32 equipping the casing modules 31, the tube 44 being retained therein by VELCRO® brand fastener strips 45 for example.

As can be seen in FIG. 27, the base 13 has on its upper face 13*a* an inflation orifice 15*b* intended to be connected to the tube 44 for inflating the tent 20 and optionally the cushions 32, as explained hereinafter.

Figure 7:
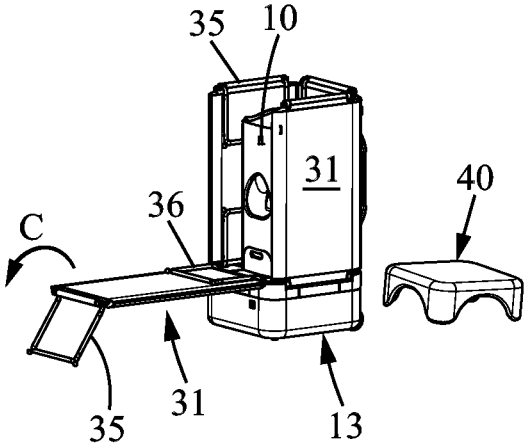
FIG. 7 is a perspective side view of the shelter from FIG. 6 showing further disengagement from its casing in a subsequent phase of deployment of the shelter (the tent not being shown)
Figure 6:
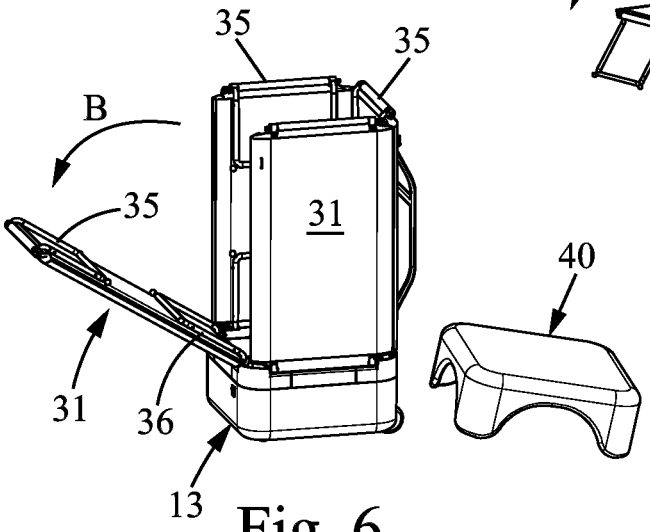
FIG. 6 is a perspective side view of the shelter from FIG. 4 showing initial disengagement of the unlocked casing relative to the column in an intermediate phase of deployment of the shelter (the tent folded onto the column not being shown)
Figure 8:
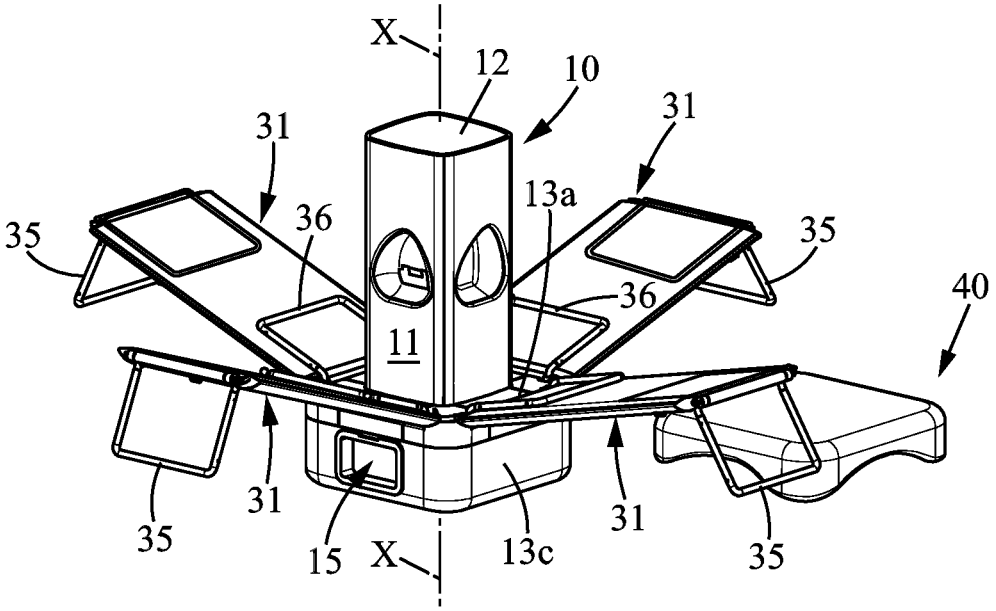
FIG. 8 is a perspective side view of the shelter from FIG. 7 showing further disengagement of its casing in a subsequent phase of deployment of the shelter (the tent not being shown)

FIGS. 6-8 illustrate one example of the structure of and preparations for deployment of the shelter 1, with each casing module 31 that here is adapted to form a bench or a table after it is pivoted in the direction of the arrow B in FIG. 6 from an initial vertical position to a final horizontal position (FIG. 7) and that may be covered by an inflatable or non-inflatable cushion 32 fixed to the seat of the bench or to the tabletop and advantageously washable and non-removable from a cushion cover. To this end each casing module 31 has at its upper and lower ends two articulated legs 35 and 36 that are retracted in the folded position of the casing 30 against the column 10 and during tilting thereof (FIG. 6) and the operative P then deploys independently, starting with the articulated leg 35 at the external end of the module 31 (see arrow C in FIG. 7), the other internal end of which may remain articulated to the base 13 of the column 10 (see FIGS. 7-8) or be separated therefrom to position the bench or the table formed by the module 31 at a required location on the floor of the shelter 1 once deployed (see FIGS. 28-29).

FIGS. 10-13 show one example of the arrangement of a unit 16 supplying drinking water and washing water including a drinking water reservoir 16*a* and a receptacle 16*b* of cups 16*c* that are accessible from the top 12 of the column 10 for stocking with water and cups 16*c* and that discharge above a washbasin 16*d* that the unit 16 in the wall of the column 11 also includes, so that the user of the washbasin 16*d* can independently take a cup 16*c* by merely pulling vertically on the cup 16*c* at the bottom of the stack and obtain water for filling the cup 16*c* and/or washing their face and hands via a tap 16*e* that communicates with the water reservoir 16*a*. The washbasin 16*d* may for example have a flat bottom and a drain outlet adjustably closed by a plug 16*f*. The reservoir 16*a* may be filled from bottles of water while remaining in the column 11 or extracted from the column 11 to refill it from an outdoor drinking water tap, or alternatively connected temporarily to an exterior drinking water standpipe.

The top 12 of the column, in the form of a pivotable cover for example may have, in addition to two orifices 12*a* and 12*b* for respectively filling the reservoir 16*a* with water and stocking the receptacle 16*b* with cups 16*c*, an opening the shape of which is specifically designed to illuminate the interior of the tent 20 once inflated with a given lighting cone. Light-emitting diodes (LED) are advantageously used for this lighting, and the column 10 may include on its wall 11 other localized lighting means (for example for lighting the washbasin 16*d* or another functional zone of the column 10) and that may even light the interior of the tent 20 once inflated by means of one or more LED strips fixed to the ribs 21 of the tent 20, for example.

FIG. 14 shows, inside the compartment 17 of the column 10 closed by a pivoting small table 17*a* (retracted at the level of the wall 11 in the folded position of the shelter 1), a socket outlet 17*b* for charging a mobile telephone T for example, which telephone may be placed on the small table 17*a* during charging and use by its owner (just like a laptop computer or other suitable object).

FIG. 15 shows a secure space for storing personal effects inside another compartment 17' of the column 10 closed by another pivoting small table 17*a'* (shown retracted against the wall 11 in the folded position of the shelter).

FIGS. 16 and 17 show coat hooks 18 fixed in the immediate vicinity of the top 12 of the column 10 on at least one of the four faces thereof. These coat hooks may advantageously be extractable so as to be retracted into the column 10 so as not to snag the canvas of the tent 20 during its deployment and to be disengaged therefrom (for example by exerting a push/pull) for use in the deployed position of the shelter.

FIGS. 18-22 show the structure and the actuation of a lower zone of the column 10 and of the base 13 thereof for regular access to the wastewater recovery unit 16' in order to empty it. It is seen in FIG. 18 that the façade 13*c* of the base 13 has two pivoting external panels 19 on two of its opposite sides, preferably sides other than the side provided with the inflation button 15*a* (this pivoting is for example obtained by a push immediately followed by a pull, see arrows D in FIGS. 18 and 19) that provide access to two wastewater reservoirs 16*a'* by opening and removing an adjacent hatch 19*a* formed by a panel removable from the lower zone of the column 10 (see arrow E in FIG. 20 for this opening). It is seen in FIGS. 21 and 22 that an operative P can therefore easily extract the two wastewater reservoirs 16*a'* from the column 10.

FIGS. 23-28 show a shelter 1' according to a second embodiment of the invention that differs from the shelter 1 from FIGS. 1-22 in that:

- the peripheral wall 11' of the column 10' and the casing modules 31' enveloping it in the folded position are also of globally prismatic shape but here are of globally triangular rather than square cross section, the other features of the shelter 1 described above being essentially unchanged, and in that:
- the cap 40' for locking/unlocking the casing 30', also of globally triangular shape, cooperates for locking purposes with the three casing modules 31' that it surmounts via a pair of metal rods forming pins 42' that the cap 40' incorporates at each of its corners for locking/unlocking the casing modules 31'.

FIG. 23 shows the tent 20 fixed to the top 12' of the column 10' and folded onto its peripheral wall 11', the means 23 connecting the tent 20 to that top 12' being visible in FIG. 28.

It is seen in FIGS. 24 and 26 that the casing modules 31' and the articulated legs 35' and 36' being retractable that they incorporate are deployed by pivoting as described above in relation to the first embodiment of the invention, the FIG. 25 insert showing an inflated cushion 32 equipping the bench formed for example by one or each casing module 31'.

As explained above and visible in FIG. 27, the tent 20 and optionally the cushion or cushions 32 is/are inflated via the unit 15 for inflating the tent 20 forming an inflation interface that may consist in an inflation button 15*a'* with a protection valve that is provided on the lateral façade 13*c* of the enlarged base 13' of the column 10' supporting the wall 11' after connecting the inflation orifice 15*b* of the base 13' to the inflation tube 44 (which tube 44 is connected to the ribs 21 of the tent 20 and optionally to the cushions 32 of the casing modules 31').

In this second embodiment of the invention, the column 10' may incorporate functionalities different from those of the first embodiment, there being visible in particular in FIG. 26 an optional support 44' for winding up the inflation tube 44.

In the FIG. 28 deployed position the means 23 for connecting the tent 20 from FIGS. 23-28 to the top of the column 10' in this example include three for example textile slings or stays 23*a* that are for example fixed to the inflatable ribs 21 of the tent 20 and by which the tent 20 is ballasted by the column 10' in the deployed position of the shelter 1'.

It will be noted that this ballasting of the shelter 1, 1' makes it possible to circumvent the disadvantages inherent to the external ballasting of inflated tents usually obtained by ropes and tent pegs and/or by ballast weights (e.g. bags of sand or water) placed at the base of the tent or of its ribs. In particular, this ballasting of the tent 20 by the column 10, 10' achieves a significant timesaving for the deployment of the shelter 1, 1' compared to that of tents with external ballasting.

It will also be noted that this ballasting inside the shelter 1, 1' makes it possible to give the tent 20 increased wind resistance compared to that of tents ballasted externally.

The tent 20 has for example a ground perimeter 22 that is polygonal and a footprint of 25 $m^2$, able to vary from approximately 20 $m^2$ to 40 $m^2$ with a mass for a 25 $m^2$ footprint tent 20 of approximately 20 kg (the column 10, 10' having a weight of approximately 40 kg, without counting the casing modules 31, 31' each of which can weigh approximately 6 kg if they form benches). It is seen in FIG. 28 that at least one of the casing modules 31' may be configured, in the deployed state and separated from the column 10', to form a relatively high table provided with two articulated legs 35' and 36' (which are telescopic, being extendable in the direction of the arrows F) at respective ends of the casing module 31', with other modules 31' in this example able to be configured to form benches each for at least two persons P and with a cushion 32 optionally inflated by the column 10' as in FIG. 25.

As can be seen in FIG. 28, it will be noted that the column 10, 10' is able to light the interior of the tent 20 by means of a lighting cone and that this column 10, 10' may be eccentric relative to the apex of the dome (not visible) of the tent 20, i.e. being in this example positioned in the vicinity of one side of the ground perimeter 22 at the bottom of the latter. The ground perimeter 22 at the bottom of the deployed tent 20 may optionally be equipped with means encouraging the circulation of air outside the tent 20.

In the FIG. 29 variant, the means 23 for connecting the column 10 to the tent 20 include a tubular, for example textile membrane 23*b* extending in the form of a right cylinder from the top 12 of the column 10 to the zone 24 of intersection of the inflatable ribs 21 (i.e. at the level of the apex of the dome). This membrane 23*b* may optionally be provided with means for lighting the interior of the tent 20.

As shown in FIGS. 28-29, the inflated ribs 21 tensioning the dome formed by the deployed tent 20 cross in these examples in accordance with a geometry reminiscent of that of a medieval architecture cloister vault, although the present invention can use other arrangements of inflatable ribs 21.

There are shown in FIG. 30 two adjacent shelters 1 according to the invention in the deployed position each provided with an individual tent 50 that is small and rapidly deployable containing a disposable WC 51, an operative being shown on the point of proceeding to deploy a third shelter 1 that can be seen in the folded position by tilting it to move it into an appropriate location. This tent 50 is preferably installed outside and in the immediate vicinity of a shelter 1 according to the invention in the deployed position (i.e. outside and alongside the inflated tent 20) so as not to penalize the comfort of other persons P accommodated in that shelter 1, and contains in addition to the for example folding (e.g. cardboard) WC 51 a single-use plastic bag. Each of the tents 20 visible in FIG. 30 has in this example at its entrance a vaulted front section forming an awning 25 the opening of which may be closed by a zipped panel.

Figure 31:
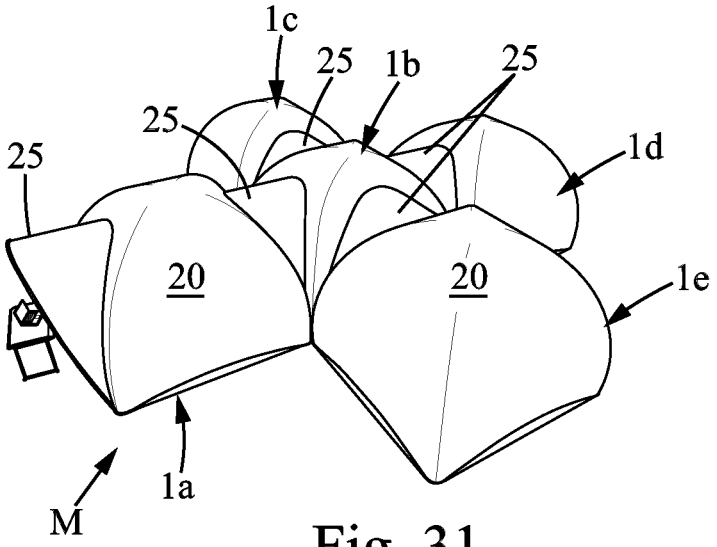
FIG. 31 is a perspective view from above of a shelter module according to one embodiment of the invention.

The example of a module M of tents 20 shown in FIG. 31 includes an arrangement of five contiguous shelters 1*a*-1*e* according to the invention the tents 20 of which define a ground perimeter 22 that is square at the bottom, each of which can be such as those visible in FIG. 30. To be more precise, the left hand shelter 1*a* includes an awning 25, for example with a zipped opening panel of the type from FIG. 30, forming the entrance of the module, and leads to a central second shelter 1*b* of the module M, which leads separately on three of its sides to three shelters 1*c*, 1 *d*, 1*e* with no exit other than the central shelter 1*b*.

It will be noted that a large number of geometrical configurations and structural arrangements can be used for a module M of shelters 1 according to the invention, possibly including shelters 1 having different footprints (determined by the geometry of the tents 20 deployed around the column 10 of each shelter 1), containing specific equipment and/or furniture such as the aforementioned means for compartmenting the space of each shelter 1 (in part determined by the arrangement of the modules 31 of each column 10 of a shelter 1 and/or by complementary equipment or furniture not provided by the column 10). For example, there may be envisaged, at the main entrance of the module M, one or more first shelter(s) 1 for receiving victims intended to cause them to wait and/or to take information as to their respective identities and situations, communicating with one or more second shelter(s) 1 so that the victims received in this way talk to a psychologist, able to communicate with one or more third shelter(s) 1 forming places to eat.

The invention claimed is:

1. An emergency shelter that is able to occupy a first, folded position for storage and transport and a second, deployed position for sheltering at least one person, the emergency shelter including an inflatable tent and a retaining device for retaining the inflatable tent in an inflated state thereof in said second position, wherein the retaining device includes a pre-assembled column having a definitive geometry common to said first position and said second position and to which the inflatable tent in an uninflated state thereof is fixed in said first position, the column being capable alone to inflate the inflatable tent and to retain the inflatable tent in the inflated state where the inflatable tent is deployed around the column in said second position.

2. The emergency shelter as claimed in claim 1, in which the column includes in said first position and said second position a peripheral column wall of globally polygonal or curved cross section, the inflatable tent being folded in said first position onto and around the peripheral column wall.

3. The emergency shelter as claimed in claim 2, in which the column contains an inflation unit for inflating the inflatable tent, the inflatable tent comprising inflatable ribs, wherein said inflation unit includes a compressor or a pyrotechnic generator of gas under pressure or at least one reservoir intended to contain a compressed gas and adapted to be connected to at least one of said inflatable ribs to be inflated.

4. The emergency shelter as claimed in claim 3, in which the column has a base that supports said peripheral column wall and is provided with means facilitating guiding movement of the emergency shelter in said first position, said base containing an electrical power supply unit of the column connected to said inflation unit.

5. The emergency shelter as claimed in claim 4, in which said base further contains said inflation unit that opens from said base via an inflation orifice adapted to be connected in an airtight manner to at least one tube for inflating the inflatable tent with which the column is provided, said base having a façade provided with a means for commanding and stopping the inflation.

6. The emergency shelter as claimed in claim 4, in which the means facilitating guiding movement of the emergency shelter in said first position are wheels.

7. The emergency shelter as claimed in claim 5, in which said peripheral column wall further contains a unit for supplying drinking water and washing water for said at least one sheltered person.

8. The emergency shelter as claimed in claim 7, in which said unit for supplying drinking water and washing water includes at least one drinking water reservoir and a receptacle of cups, both accessible from a top of the column, and a washbasin in said peripheral column wall communicating with said at least one drinking water reservoir via a tap.

9. The emergency shelter as claimed in claim 7, in which said base further contains a unit for recovering waste water, said base and/or an adjacent lower part of said peripheral column wall including removable or pivoting external panels enabling access to said recovery unit.

10. The emergency shelter as claimed in claim 1, in which the retaining device further includes connecting means for connecting the inflatable tent to the column that surmount the column and are deployable to be brought from said first position to said second position in which the column, provided with said connecting means, ballasts the inflatable tent.

11. The emergency shelter as claimed in claim 3, in which the connecting means for connecting the inflatable tent to the column are cables or a tubular membrane.

12. The emergency shelter as claimed in claim 1, in which the column further includes a storage battery, at least one secure rack for storing personal effects of said at least one person, at least one coat hook, and at least one small folding table.

13. The emergency shelter as claimed in claim 12, in which the at least one small folding table is suitable for consulting and/or charging laptop computers or smartphones by means of said storage battery.

14. The emergency shelter as claimed in claim 1, in which the column further includes self-contained lighting means able to light in an adjustable manner by means of at least one lighting cone, from an upper end of the column, the interior of the inflatable tent deployed in said second position and optionally also one or more particular locations on the column.

15. The emergency shelter as claimed in claim 1, in which the emergency shelter further includes a lockable casing which, in said first position, envelops the inflatable tent folded around a peripheral wall of said column of globally polygonal or curved cross section, said lockable casing being adapted to be separated from the inflatable tent and from said peripheral column wall to allow inflation of the inflatable tent.

16. The emergency shelter as claimed in claim 15, in which said lockable casing includes at least two casing modules that can be folded after unlocking by pivoting about a vertical axis of symmetry of the column.

17. The emergency shelter as claimed in claim 16, in which said at least two casing modules are mounted to pivot independently of one another on a base of the column before inflating the inflatable tent, each of said at least two casing modules being optionally separatable from the column and adapted to be disposed on ground receiving the emergency shelter to form there an item of furniture or a ground covering element.

18. The emergency shelter as claimed in claim 17, in which at least one of said at least two casing modules is provided with articulated legs which are retractable and optionally telescopic, and is adapted to form said item of furniture that is optionally inflatable by said column and is selected from tables and seats.

19. The emergency shelter as claimed in claim 17, in which each of said at least two casing modules is adapted to form there the ground covering element which is a floor panel.

20. The emergency shelter as claimed in claim 16, in which at least one of said at least two casing modules has an external face provided with means for holding and/or guiding the emergency shelter in said first position, in order to move the emergency shelter and to transport the emergency shelter in a vehicle.

21. The emergency shelter as claimed in claim 20, in which the means for holding and/or guiding the emergency shelter in said first position are handles, ramps, or rails.

22. The emergency shelter as claimed in claim 16, in which the emergency shelter further includes a cap removably surmounting said peripheral column wall and in said first position locking said at least two casing modules around the inflatable tent, said cap optionally enclosing a tube for inflating the inflatable tent adapted to be connected to an inflation unit contained in the column.

23. The emergency shelter as claimed in claim 16, in which said at least two casing modules, before being folded, have when assembled together a globally cylindrical or prismatic geometry around said vertical axis, like said peripheral column wall.

24. The emergency shelter as claimed in claim 1, in which the inflatable tent includes inflatable ribs and a flexible canvas that interconnects said inflatable ribs, the flexible canvas incorporating photovoltaic modules and/or resistive heating elements.

25. A module of contiguous emergency shelters wherein the module includes a plurality of emergency shelters as claimed in claim 1 that are contiguous and interconnected by flexible partitions or awnings with openings adapted to be closed.

26. A method for reversibly converting an emergency shelter from a first, folded storage and transport position to a second, deployed position adapted to shelter at least one person, the emergency shelter including an inflatable tent retained in said second position, wherein the method includes:

a) providing a column that is preassembled before said first position is obtained and that has a definitive geometry common to said first position and said second position, b) fixing the inflatable tent in an uninflated state thereof to the column to obtain said first position, and c) inflating the inflatable tent by means of the column alone to obtain said second position in which the inflatable tent, in an inflated state thereof, is deployed around the column and retained by the column.

27. The method as claimed in claim 26, in which step b) includes folding the inflatable tent onto the column and around the column, the inflatable tent being inside a lockable casing which is around the inflatable tent parallel to a vertical axis of symmetry of the column, before said lockable casing is separated from the inflatable tent and from the column between steps b) and c) to allow step c).

28. The method as claimed in claim 27, in which said lockable casing is separated from the column by folding around said vertical axis at least two modules of said lockable casing mounted to pivot on the column in an optionally separatable manner, and in which said at least two casing modules, once deployed, are used as furniture or as elements for covering a floor of the emergency shelter.

29. The method as claimed in claim 28, in which said at least two casing modules, once deployed, are used as tables or seats or as floor panels.

* * * * *